US007132615B1

(12) United States Patent
Greer

(10) Patent No.: US 7,132,615 B1
(45) Date of Patent: Nov. 7, 2006

(54) SWITCHPAD FOR A PUSHBUTTON SWITCH ASSEMBLY

(75) Inventor: Donald J. Greer, Kempton, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/111,351

(22) Filed: Apr. 21, 2005

(51) Int. Cl.
*H01H 9/00* (2006.01)

(52) U.S. Cl. ..... 200/313; 200/314

(58) Field of Classification Search ..... 200/6 A, 200/4, 5 R, 5 A, 310–314, 17 R, 18, 341, 200/512–520, 329
See application file for complete search history.

(56) References Cited

U.S. PATENT DOCUMENTS 4,518,833 A * 5/1985 Watkins ..... 200/5 A
4,527,030 A * 7/1985 Oelsch ..... 200/515
5,285,037 A * 2/1994 Baranski et al. ..... 200/314
5,438,177 A * 8/1995 Fagan ..... 200/517
5,510,584 A * 4/1996 Norris ..... 200/5 A
5,536,911 A * 7/1996 Madill ..... 200/6 A
5,710,397 A * 1/1998 Liao ..... 200/5 A
5,717,176 A * 2/1998 Dahlstrom ..... 200/1 B
5,738,450 A * 4/1998 Lukosch ..... 400/495
5,824,978 A * 10/1998 Karasik et al. ..... 200/18
5,826,708 A 10/1998 Finlay
6,239,391 B1 * 5/2001 Nishijima et al. ..... 200/5 A
6,613,990 B1 * 9/2003 Kawasaki ..... 200/6 A
6,614,380 B1 9/2003 Desai et al.
6,617,536 B1 9/2003 Kawaguchi

FOREIGN PATENT DOCUMENTS

JP 401159917 A * 6/1989

* cited by examiner

*Primary Examiner*—Elvin Enad
*Assistant Examiner*—Lisa Klaus
(74) *Attorney, Agent, or Firm*—Jimmy L. Funke

(57) ABSTRACT

A switchpad for use within a pushbutton switch assembly including a web connecting a spacer and a contact support.

19 Claims, 6 Drawing Sheets

SWITCHPAD FOR A PUSHBUTTON SWITCH ASSEMBLY

TECHNICAL BACKGROUND

The present invention relates generally to pushbutton switch assemblies and, more particularly, to a switchpad for use within a pushbutton switch assembly.

BACKGROUND OF THE INVENTION

Pushbutton switch assemblies including deformable switchpads are known in the art. Such pushbutton switch assemblies often incorporate conical or semi-spherical switchpads in order to facilitate deformation thereof in response to axially directed forces. These pushbutton switch assemblies are often used to execute a desired function for electro-mechanical devices including audio equipment. More particularly, a pushbutton actuator typically transmits an axial force from the operator against the switchpad, thereby pressing a conductive pill or contact located on the switchpad into electrical communication with an underlying circuit board trace pattern. This electrical communication results in completion of a circuit, thereby causing the desired function to execute. The switchpad may be resilient in order to provide tactile feedback to the operator.

SUMMARY OF THE INVENTION

According to an illustrative embodiment of the present invention, a switchpad for use within a pushbutton switch assembly includes a contact support having an outer wall with a lower surface and defining an opening. An electrical contact is supported by the lower surface of the contact support. The switchpad further includes a spacer having a lower surface, wherein the electrical contact is supported for movement relative to the spacer. A web couples the outer wall of the contact support to the spacer and is configured to resiliently deform as the contact support is moved relative to the spacer from a raised position to a lowered position. The spacer is configured to extend within the opening of the contact support when the contact support is in the lowered position.

In a further illustrative embodiment of the present invention, a switchpad includes a contact support defining a longitudinal axis and an electrical contact supported by the contact support. A spacer extends longitudinally downwardly relative to the contact support. A web connects the spacer and the contact support, and extends laterally outwardly from the spacer to the contact support and longitudinally upwardly from the spacer to the contact support.

According to yet another illustrative embodiment of the present invention, a pushbutton switch assembly includes an actuator defining a longitudinal axis, and a switchpad. The switchpad includes a contact support having an outer wall defining an opening, an electrical contact supported by the contact support, a spacer extending longitudinally away from the contact support, and a web coupling the contact support to the spacer. A circuit board includes a trace pattern, wherein the switchpad is positioned intermediate the actuator and the circuit board. The switchpad includes a first position wherein the electrical contact is positioned in spaced relation to the trace pattern of the circuit board, and a second position where the electrical contact is in contact with the trace pattern of the circuit board, and the spacer extends within the opening of the contact support.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Figure 1:
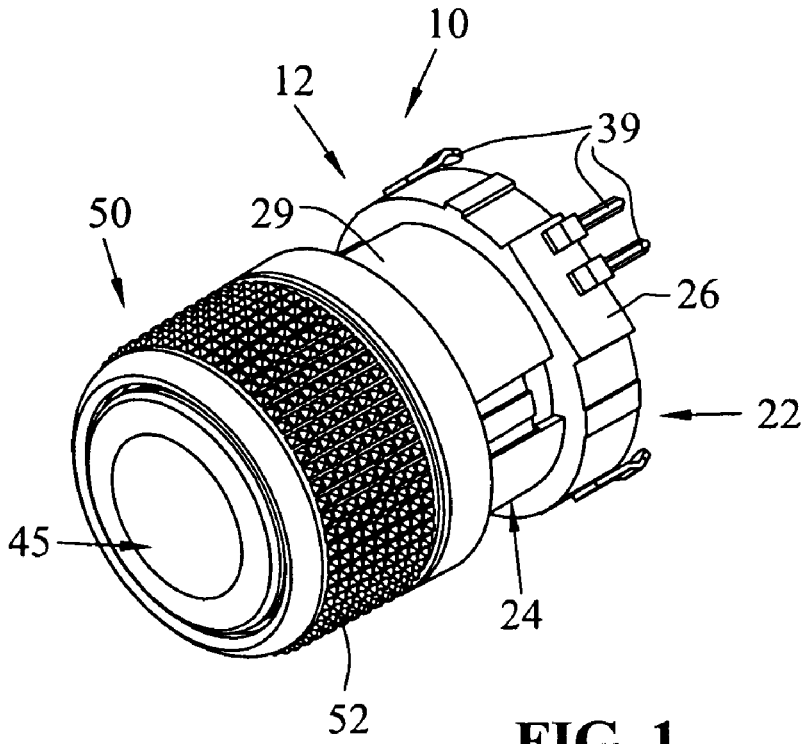
FIG. 1 is a perspective view of a pushbutton switch assembly according to an illustrative embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms and such exemplification is not to be construed as limiting the scope of the invention in any manner.

DESCRIPTION OF INVENTION

The embodiments discussed below are not intended to be exhaustive or limit the invention to the precise forms disclosed in the following detailed description. Rather, the embodiments are chosen and described so that others skilled in the art may utilize their teachings.

Figure 2:
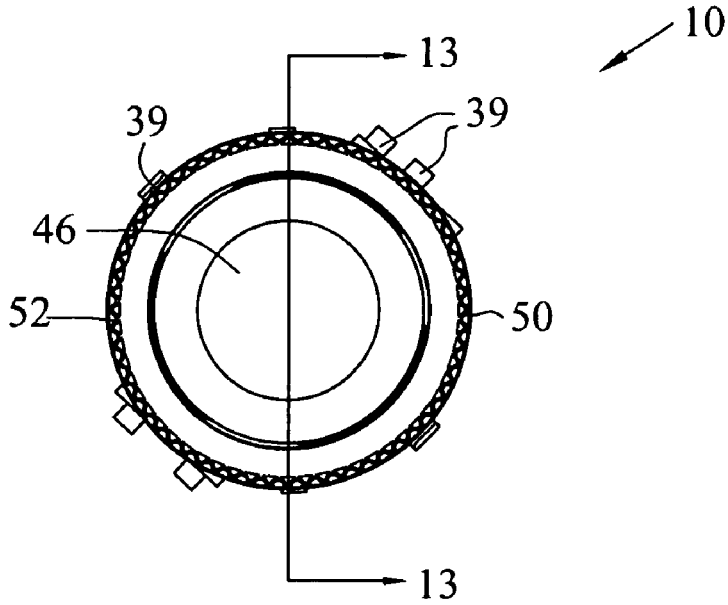
FIG. 2 is a top plan view of the pushbutton switch assembly of FIG. 1.
Figure 3:
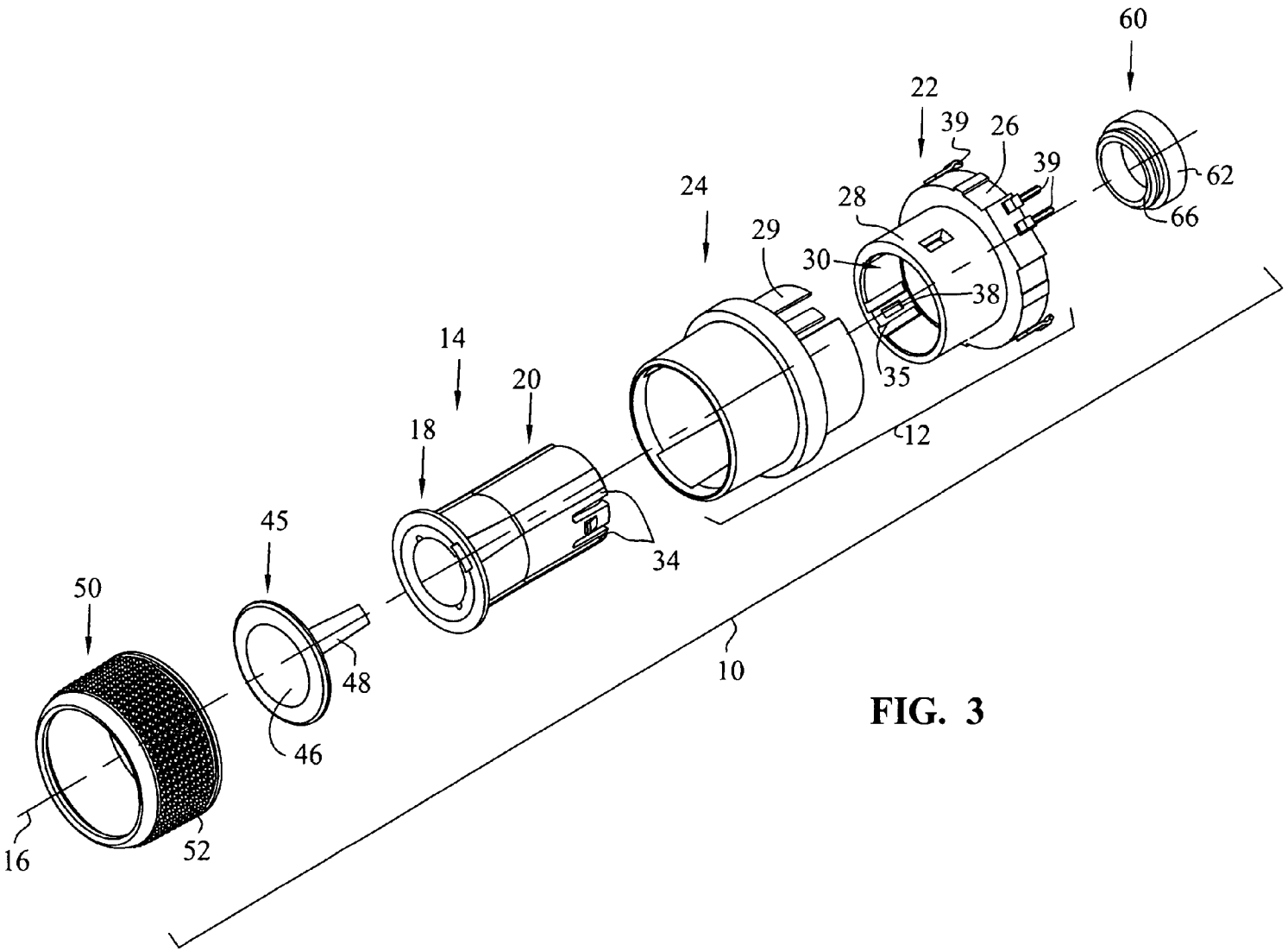
FIG. 3 is an exploded perspective view of the pushbutton switch assembly of FIG. 1.
Figure 4:
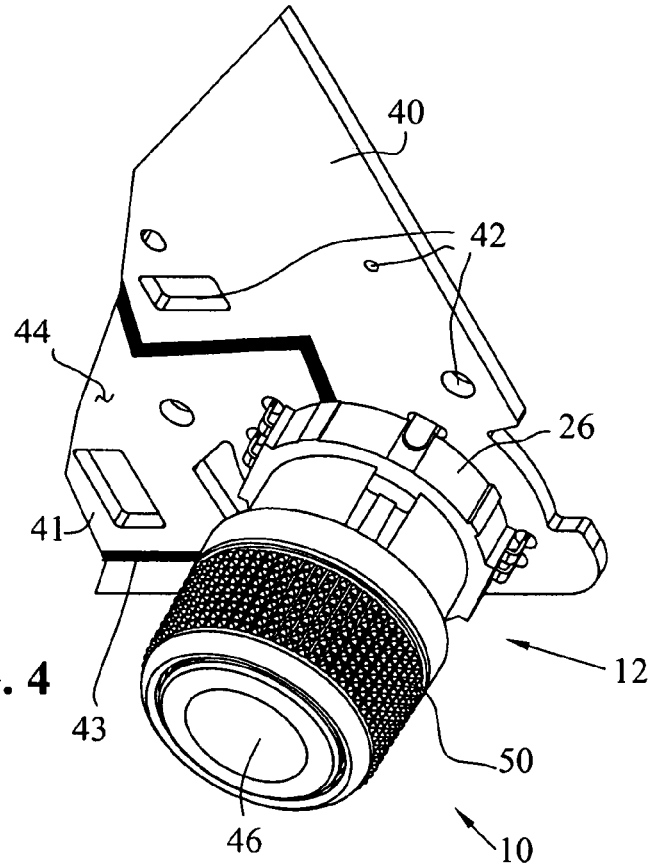
FIG. 4 is a perspective view of the pushbutton switch assembly of FIG. 1 coupled to a portion of a circuit board.
Figure 6:
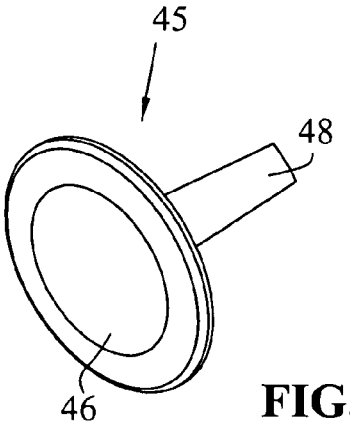
FIG. 6 is a end cap configured to couple to the actuator of FIG. 5.

Referring initially to FIGS. 1–3, a pushbutton switch assembly 10 is illustrated as including a body 12 configured to slidably receive an actuator 14. The actuator 14 defines a longitudinal axis 16 and includes opposing first and second ends 18 and 20. The body 12 includes a support 22 rotatably supporting a cylindrical outer housing 24. More particularly, the body 12 of the illustrative embodiment is configured to provide a conventional rotary control function. However, it should be appreciated that the present invention may be utilized with a wide variety of pushbutton switch assemblies, with or without a rotary control function.

The support 22 includes a base 26 and a longitudinally extending cylindrical wall 28. A cylindrical wall 29 of the outer housing 24 is concentrically and rotatably received around the cylindrical wall 28 of the support 22, and is coaxially aligned with the longitudinal axis 16. In turn, the cylindrical wall 28 defines an opening or passageway 30 configured to slidably receive the actuator 14 for axial movement along the longitudinal axis 16.

Figure 5:
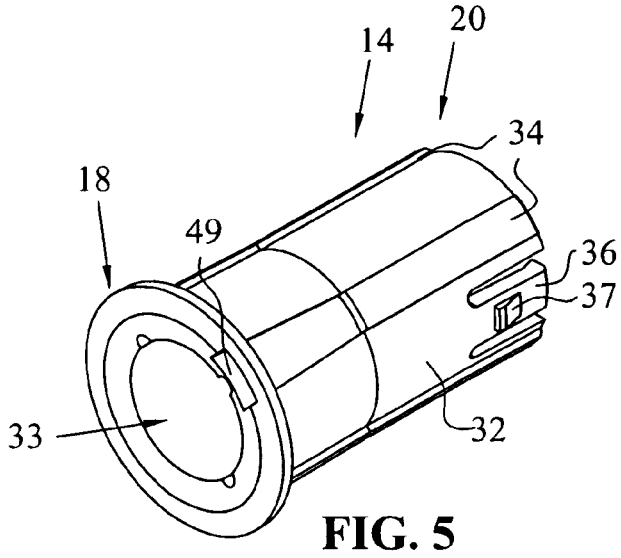
FIG. 5 is a perspective view of an actuator of the pushbutton switch assembly of FIG. 1.
Figure 7:
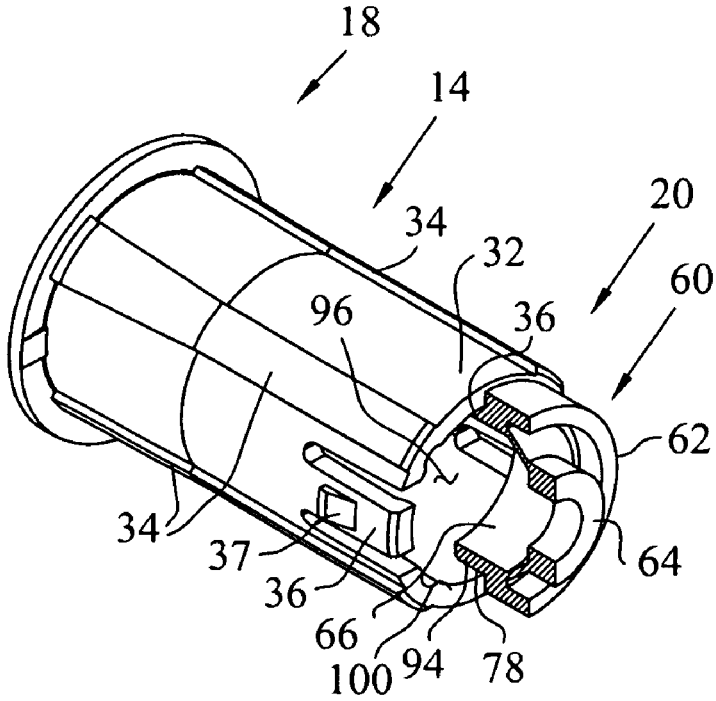
FIG. 7 is a perspective view of the actuator of FIG. 5 coupled to a switchpad, with a partial cut-away thereof.
Figure 8:
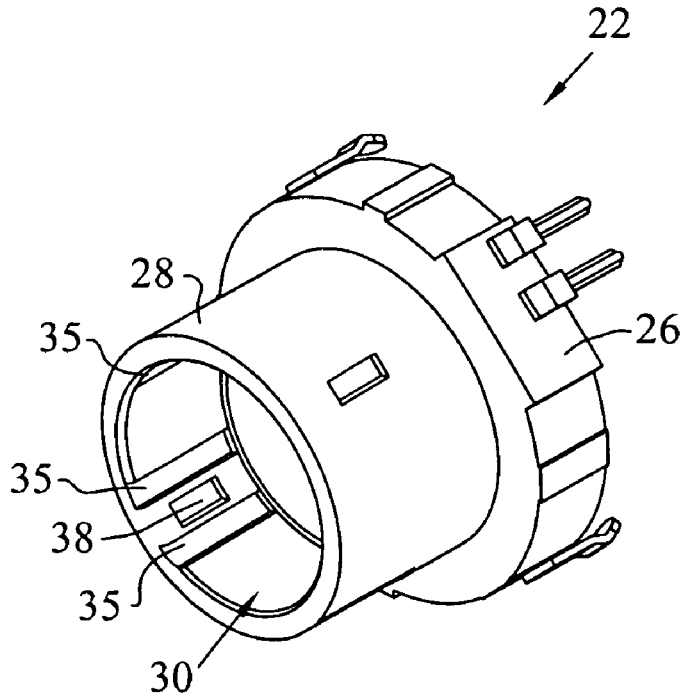
FIG. 8 is a perspective view of a support of the pushbutton switch assembly of FIG. 1.
Figure 9:
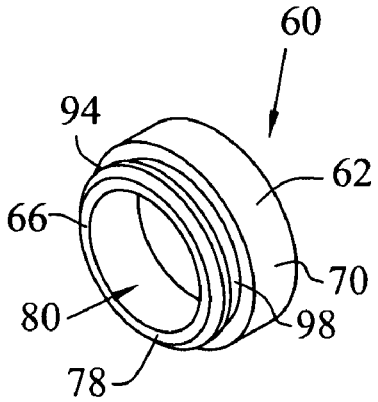
FIG. 9 is a front perspective view of the switchpad of the pushbutton switch assembly of FIG. 1.
Figure 10:
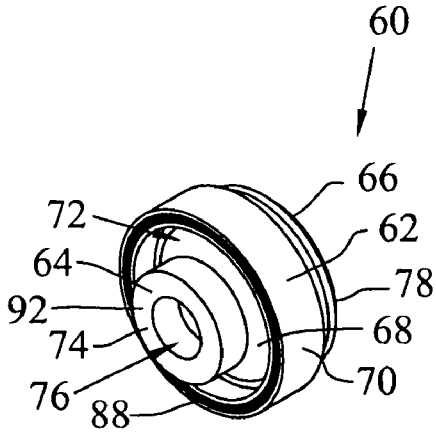
FIG. 10 is a rear perspective view of the switchpad of FIG. 9.

Referring now to FIGS. 3, 5, and 8, the actuator 14 illustratively includes a cylindrical wall 32 defining an opening or passageway 33. A plurality of longitudinally extending ribs 34 are supported by an outer surface of the wall 32 and are configured to cooperate with a plurality of longitudinally extending grooves or slots 35 formed within an inner surface of the wall 28 of the support 22. Cooperation between the ribs 34 and grooves 35 assists in aligning the actuator 14 relative to the body 12 and preventing rotation therebetween. The second end 20 of the actuator 14 may include a set of opposing, biased retaining tabs 36, each supporting a locking element 37 (FIG. 7). The locking elements 37 are configured to engage a set of opposing ribs 38 supported by the housing 24 (only one shown in FIG. 8). As such, the actuator 14 may move axially within the housing 24, but removal thereof is prevented by the locking elements 37 engaging the ribs 38.

With reference to FIGS. 1, 2, 3, 4, 13 and 14, a plurality of retaining pins and terminals 39 extend downwardly from the base 26 and are configured to be received within a printed circuit board 40. The circuit board 40 may be of conventional design as including a substrate 41 having a plurality of receiving apertures 42 for receiving the retaining pins or terminals 39 and having a trace pattern or contact 43 supported on an upper surface 44 of the substrate 41.

Referring now to FIGS. 1–6, an end cap 45 is coupled to the first end 18 of the actuator 14. Illustratively, the end cap 45 includes a disk portion 46 and a downwardly extending locking tab 48 configured to securely engage a cooperating portion 49 of the actuator 14. The disk portion 46 is illustratively formed from a translucent material such that light passing through the passageway 33 of the actuator 14 illuminates the end cap 45. While in the illustrative embodiment, the end cap 45 and the actuator 14 are separate components, it should be appreciated that the end cap 45 may be integrally molded with the actuator 14 in a two shot injection molding process. In such a process, the locking tab 48 may instead comprise a gate for molding the end cap 45.

As illustrated in FIGS. 1–3, 13, and 14, a knob 50 including a gripping surface 52, illustratively a plurality of small protrusions, is concentrically received about the actuator 14 and the outer housing 24 of the body 12. The knob 50 is coupled to the outer housing 24 such that rotation of the knob 50 by an operator causes similar rotation of the outer housing 24 relative to the support 22. As noted above, relative rotation of the outer housing 24 relative to the support 22 provides a rotary control function. Illustratively, the outer housing 24 and the knob 50 may be integrally formed during a multi-shot injection molding process.

Figure 14:
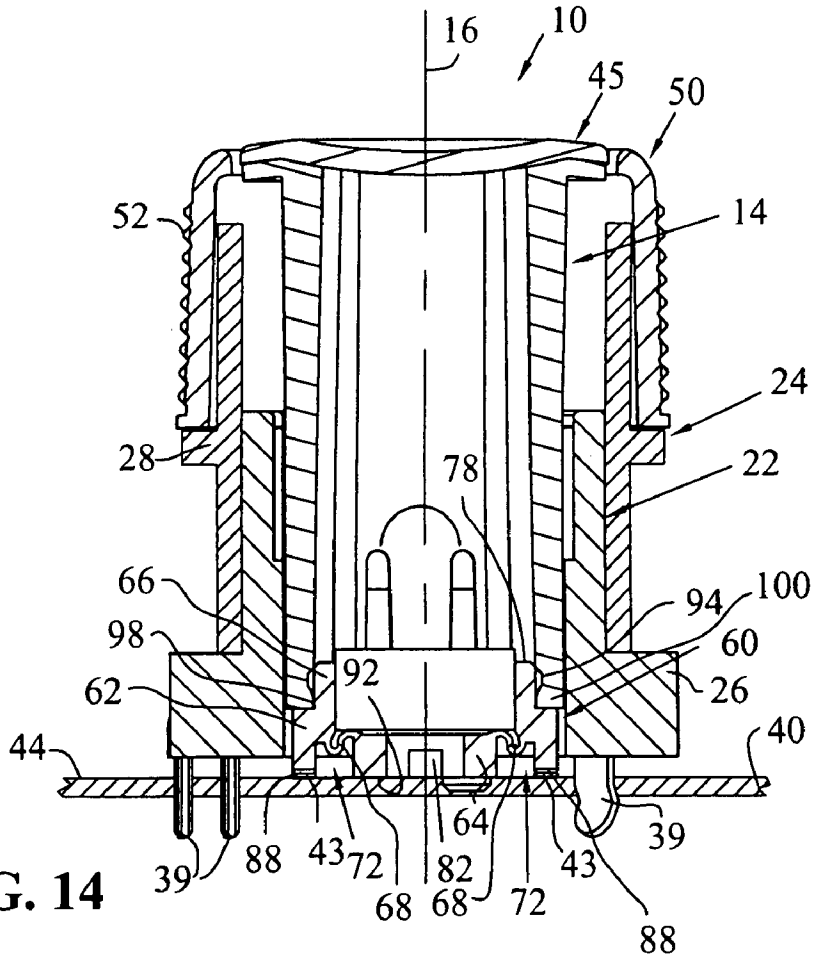
FIG. 14 is a cross-sectional view of the pushbutton switch assembly similar to FIG. 13, illustrating the switchpad in a second position, with the contact of the switchpad in contact with the trace pattern of the circuit board.

With reference now to FIGS. 7, and 9–14, a switchpad 60 is coupled to the second end 20 of the actuator 14. The switchpad 60 illustratively includes a contact support 62, a spacer 64 extending longitudinally outwardly from the contact support 62 in a first, downward direction, and a retainer 66 extending longitudinally outwardly from the contact support 62 in a second, upward direction. A web 68 couples the contact support 62 to the spacer 64. As detailed below, the web 68 is configured to resiliently deform as the contact support 62 is moved longitudinally relative to the spacer 64 from a first, raised position (FIG. 13) to a second, lowered position (FIG. 14). While in the illustrated embodiment the web 68 comprises a truncated cone, it should be appreciated that the web 68 may take the form of other shapes, such as a semi-spherical dome. Further, the web 68 could be configured to provide multiple functions with successively larger, or smaller, concentric webs and contact details, the latter actuating functions with different force travel characteristics than the first. In the illustrative embodiment, the contact support 62, the spacer 64, and the web 68 are integrally formed as a single silicone body. However, in alternative embodiment the contact support 62, the spacer 64, and the web 68 may be independently formed from other materials.

The contact support 62 includes a cylindrical wall 70 defining an opening or passageway 72. The web 68 extends laterally outwardly away from the longitudinal axis 16 and longitudinally inwardly in the second, upward direction from the spacer 64 to the cylindrical wall 70. The spacer 64 includes a cylindrical wall 74 defining an opening 76. Similarly, the retainer 66 includes a cylindrical wall 78 defining an opening 80. The openings 72, 76, 80 within the switchpad 60 provide for the transmission of light from a light source 82 supported by the circuit board 40 (FIGS. 13 and 14), either above, below, or within the substrate 41. The light source 82 illustratively comprises a light emitting diode (LED). The longitudinally upwardly and laterally outwardly disposition of the web 68 facilitates the direction of light from the light source 82 upwardly through the actuator 14. While the openings 72, 76, 80 illustratively define a light transmission path, they may alternatively contain a functioning component. As may be appreciated, the light source 82 and openings 72, 76, 80 may be eliminated in their entireties if desired.

Figure 11:
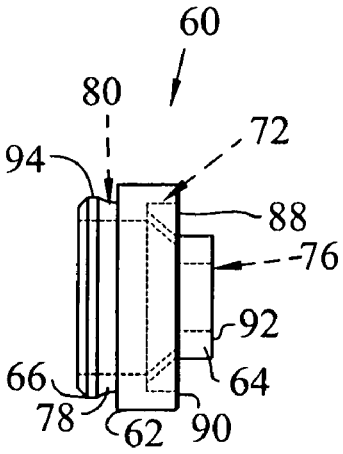
FIG. 11 is a side elevational view of the switchpad of FIG. 9, with the interior structure identified with hidden lines.
Figure 12:
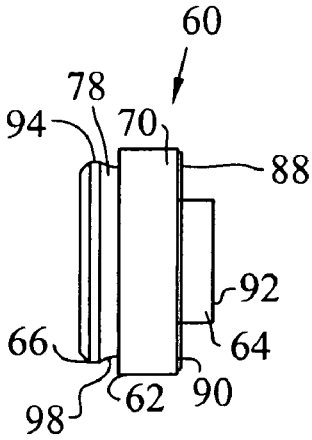
FIG. 12 is a side elevational view of the switchpad similar to FIG. 11.

A contact 88 is supported by a lower surface 90 of the contact support 62 (FIGS. 11 and 12). The contact 88 may comprise any electrically conductive material and, illustratively comprises a conductive ink applied to the lower surface 90. Other illustrative electrically conductive materials include, but are not limited to, carbon impregnated pills and gold plated contacts. While the contact 88 of the illustrative embodiment comprises an annular ring, it should be appreciated that other arrangements of conductive material may be utilized. For example, the contact 88 may include a segmented series of arcuate conductive elements arranged around the circumference of the contact support 62. If a segmented contact 88 is utilized, then the switch assembly 10 may include a key (not shown) for proper orientation or clocking. Such a segmented contact 88 could permit switching more than one function with an appropriate trace pattern 43 on the circuit board 40. The spacer 64 includes a lower surface 92 which is configured to be positioned in abutting relationship with the upper surface 44 of the circuit board 40.

With reference to FIGS. 7, 9, and 11–14, the retainer 66 includes an annular retaining ring 94 formed at an upper end thereof. More particularly, the retaining ring 94 comprises a flared portion of the cylindrical wall 78 which is configured to frictionally engage the inner surface 96 of the cylindrical wall 32 of the actuator 14 (FIG. 7). Additionally, the retaining ring 94 may include an undercut 98 configured to receive a molded projection 100 extending inwardly from the cylindrical wall 32 of the actuator 14. As such, the switchpad 60 is coupled to the second end 20 of the actuator 14.

Figure 13:
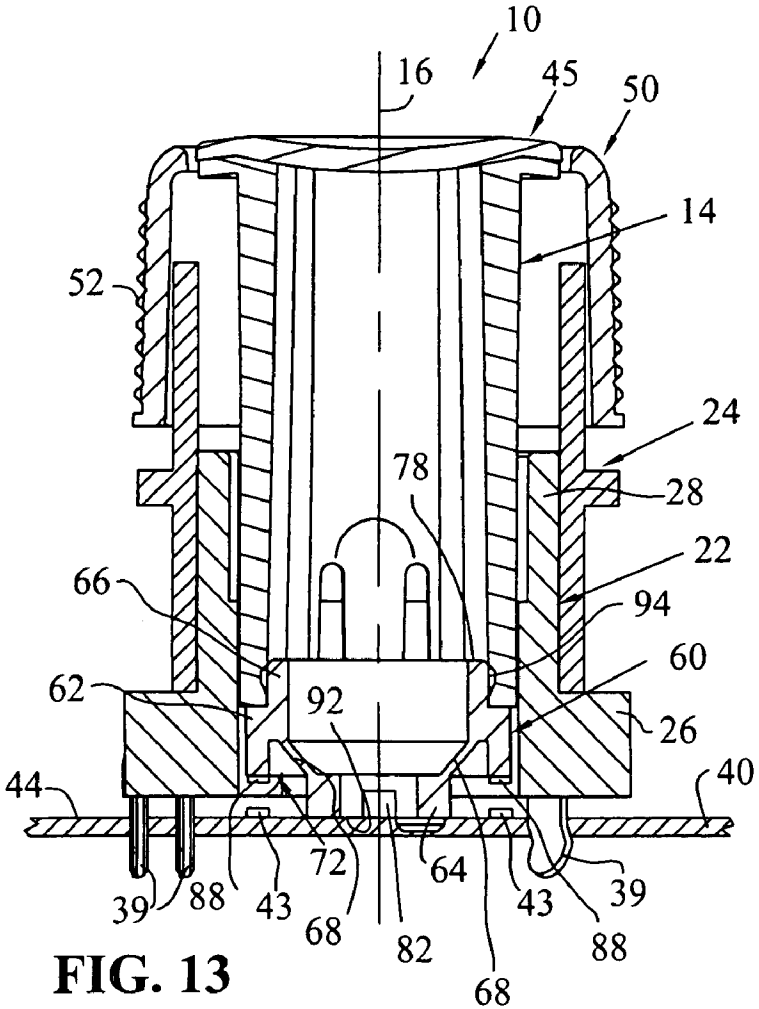
FIG. 13 is a cross-sectional view taken along line 13—13 of FIG. 2, illustrating the pushbutton switch assembly supported on a circuit board and the switchpad in a first position, with the contact of the switchpad positioned in spaced relation above the trace pattern of the circuit board.

Operation of the pushbutton switch assembly 10 of the present invention is illustrated in FIGS. 13 and 14. In a non-actuated state as illustrated in FIG. 13, the actuator 14 is supported longitudinally above the circuit board 40 such that the contact 88 of the switchpad 60 is positioned in spaced relation to the cooperating trace pattern 43 supported on the upper surface 44 of the circuit board 40. In other words, the contact support 62 is positioned in a first or raised position relative to the spacer 64.

When an operator sufficiently depresses the actuator 14, the pushbutton switch assembly 10 is in an actuated condition as illustrated in FIG. 14. More particularly, axial movement of the actuator 14 toward the circuit board 54 causes the second end 20 of the actuator 14 to force the contact support 62 of the switchpad 60 longitudinally downwardly toward the circuit board 40. In response to the movement of the actuator 14, the contact support 62 moves downwardly toward the circuit board 40 until the contact 88 engages the trace pattern 43 of the circuit board 40. Movement of the contact support 62 relative to the spacer 64 causes the web 68 to resiliently deform as illustrated in FIG. 14. When the contact support 62 is in this second or lowered position relative to the spacer 64, the spacer 64 is concentrically received within the opening 72 of the contact support 62. As known in the art, contact between the contact 88 and the trace pattern 44 provides electrical communication therebetween, thereby causing a circuit to close and a desired function to execute.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A switchpad for use within a pushbutton switch assembly, the switchpad comprising:

a contact support including an outer wall having a lower surface and defining an opening;

an electrical contact supported by the lower surface of the contact support;

a spacer having a lower surface, the electrical contact being supported for movement relative to the spacer;

a web coupling the outer wall of the contact support to the spacer, the web extending longitudinally and radially outwardly from the spacer to the contact support and being configured to resiliently deform as the contact support is moved relative to the spacer from a raised position to a lowered position; and wherein the spacer extends within the opening of the contact support when the contact support is in the lowered position.

2. The switchpad of claim 1, wherein the contact support, the spacer, and the web are formed of silicone.

3. The switchpad of claim 1, wherein the web comprises a dome configuration.

4. The switchpad of claim 1, wherein the spacer includes a central opening configured to receive light from a light source.

5. The switchpad of claim 1, further comprising a retainer extending upwardly from the contact support and configured to couple to an actuator.

6. The switchpad of claim 1, wherein the electrical contact comprises an electrically conductive ink positioned on the lower surface of the contact support.

7. A switchpad comprising:

a contact support comprising a cylindrical wall with an inner diameter and defining a longitudinal axis;

an electrical contact supported by the contact support;

a spacer extending longitudinally relative to the contact support and having an outer diameter smaller than the inner diameter of the contact support; and a web resiliently connecting the spacer and the contact support, the web extending both longitudinally and radially therebetween and being resilient to permit longitudinal movement therebetween.

8. A switchpad comprising:

a contact support defining a longitudinal axis;

an electrical contact supported by the contact support;

a spacer extending longitudinally downwardly relative to the contact support; and a web connecting the spacer and the contact support, the web extending laterally outwardly from the spacer to the contact support and longitudinally upwardly from the spacer to the contact support and further being resiliently deformable to permit longitudinal movement of the spacer relative to the contact support, wherein the contact support, the spacer, and the web are formed as an integral molded body.

9. The switchpad of claim 7, wherein the body is formed of silicone.

10. The switchpad of claim 7, wherein the web comprises a dome configuration.

11. The switchpad of claim 7, wherein the spacer includes an opening centered about the longitudinal axis and configured to receive light from a light source.

12. The switchpad of claim 7, further comprising a retainer extending longitudinally upwardly from the contact support, the retainer being configured to couple to an actuator.

13. The switchpad of claim 7, wherein the electrical contact comprises an annular ring of electrically conductive ink positioned on the contact support.

14. A switchpad comprising:

a contact support defining a longitudinal axis;

an electrical contact supported by the contact support;

a spacer extending longitudinally downwardly relative to the contact support; and a web connecting the spacer and the contact support, the web extending laterally outwardly from the spacer to the contact support and longitudinally upwardly from the spacer to the contact support, wherein the contact support includes a cylindrical outer wall, and the spacer includes a cylindrical outer wall coaxially aligned with the cylindrical outer wall of the contact support.

15. A pushbutton switch assembly comprising:

an actuator defining a longitudinal axis;

a switchpad including a contact support having a wall defining a longitudinal opening therethrough, an electrical contact supported by the contact support, a spacer extending longitudinally away from the contact support, and a web resiliently coupling the contact support to the spacer so as to permit longitudinal movement therebetween in response to a longitudinal movement of the actuator;

a circuit board including a trace pattern, the switchpad positioned intermediate the actuator and the circuit board; and wherein the switchpad includes a first position where the electrical contact is positioned in spaced relation to the trace pattern of the circuit board, and a second position where the electrical contact is in contact with trace pattern of the circuit board, and the spacer extends within the opening of the contact support.

16. The pushbutton switch assembly of claim 15, further comprising a body configured to slidably receive the actuator.

17. The pushbutton switch assembly of claim 15, wherein the web of the switchpad extends upwardly and outwardly from the spacer to the contact support.

18. The pushbutton switch assembly of claim 15, further comprising a light source supported by the circuit board, wherein the spacer includes a central opening configured to receive light from the light source.

19. The pushbutton switch assembly of claim 15, wherein the switchpad further includes a retainer extending upwardly from the contact support, and the actuator includes a passageway configured to receive the retainer.

* * * * *